United States Patent [19]

Nayagam

[11] 4,378,203

[45] Mar. 29, 1983

[54] CONCRETE MOULD AND METHOD OF MOULDING CONCRETE PANELS

[76] Inventor: Kandiah T. Nayagam, No. 6B, 2nd Floor, Lorong Meden Tuanku Satu, Kuala Lumpur, Malaysia

[21] Appl. No.: 150,041

[22] Filed: Aug. 15, 1980

[30] Foreign Application Priority Data

May 15, 1979 [GB] United Kingdom ..... 7916859

[51] Int. Cl.[3] ..... B28B 23/06

[52] U.S. Cl. ..... 425/111; 249/65; 249/127; 249/177; 264/228; 264/314; 425/150; 425/162; 425/DIG. 44; 425/DIG. 124

[58] Field of Search ..... 249/127, 65, 177; 425/DIG. 44, DIG. 124, 111, 150, 162; 264/228, 314

[56] References Cited

U.S. PATENT DOCUMENTS 3,161,938 12/1964 Graham ..... 425/DIG. 44

*Primary Examiner*—Thomas P. Pavelko
*Attorney, Agent, or Firm*—Charles A. Brown

[57] ABSTRACT

A concrete mould employs resilient side shuttering, made of rubber for example, which is prevented from deflecting, when concrete is poured, by tensioning wires extending along the length of the shuttering. Pieces of the shuttering, forming the sides of a casting box, extend between fixed end plates having a series of holes to receive the tensioning wires for adjusting the modular width of panels cast in the box. A series of apertures is provided in each piece of side shuttering so that pneumatic core formers can be inserted through aligned apertures so as to extend across the casting box. Different types of joint formers, either fully or partly resilient, can be located about the core formers, each joint former having a series of grooves to receive reinforcement or tensioning wires or rods. When inflated the pneumatic core former locks the joint formers in place. Opening formers can be made from the shuttering and the joint formers. Standard reinforcement cages can be located in the casting box at modular position corresponding with aligned apertures in the side pieces of shuttering. The modular positions are digitally coded to enable the casting process to be automated by a machine travelling on rails along the length of a casting bed which supports the side shuttering and end plates. The machine stops at the modular position to locate the respective formers and/or reinforcement cages and it also carries out automatic functions such as cleaning and oiling, laying, packing, screeding and finishing wet concrete.

11 Claims, 37 Drawing Figures

Fig. 5.
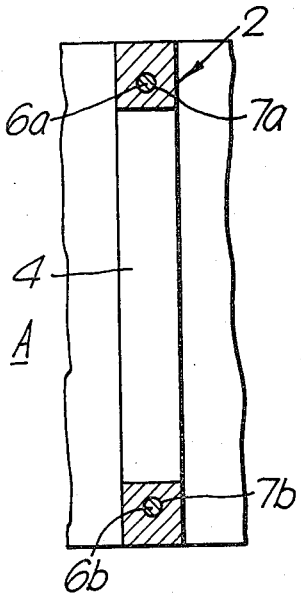
Fig. 6.
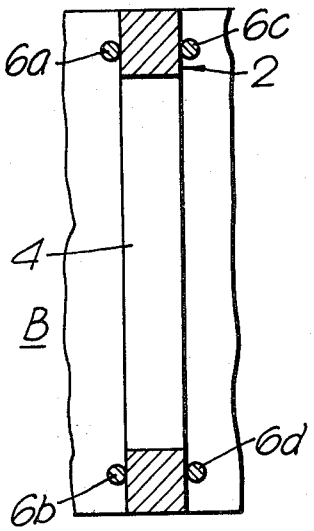
Fig. 7.
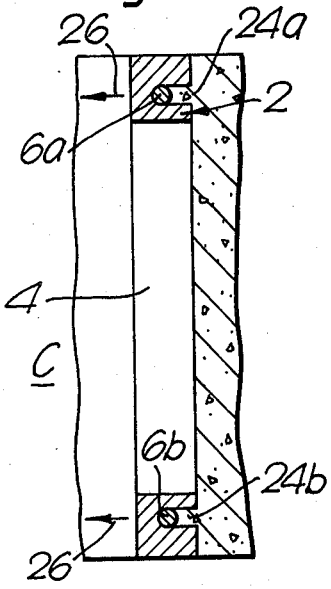
Fig. 8.
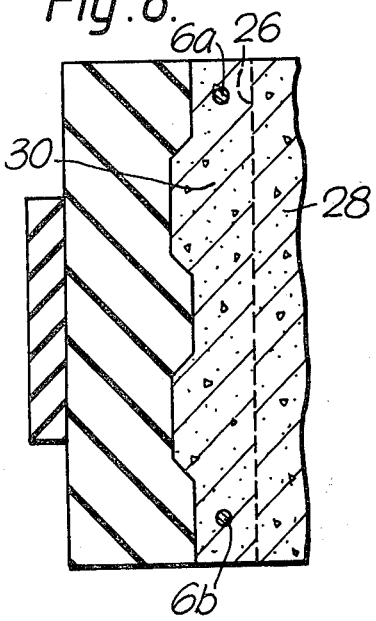
Fig. 9.
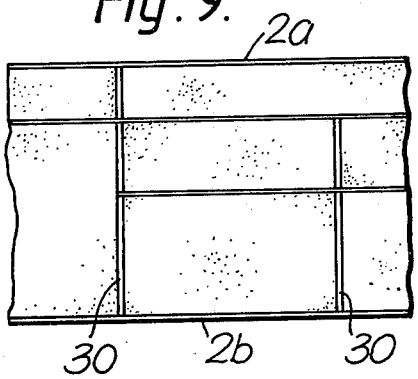
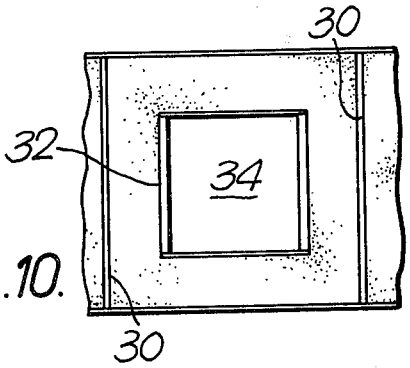
Fig. 10.

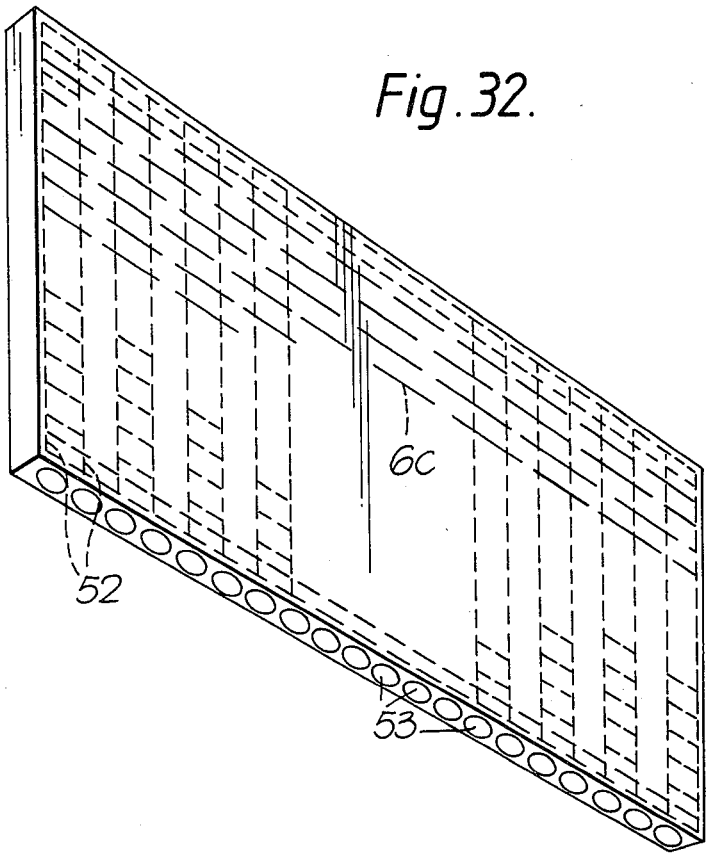
Fig. 32.
Fig. 33.
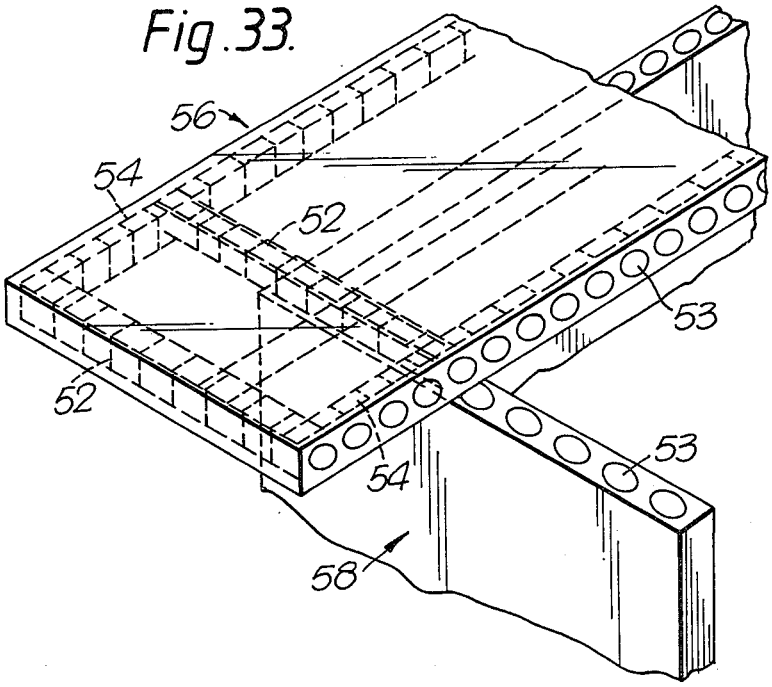

CONCRETE MOULD AND METHOD OF MOULDING CONCRETE PANELS

This invention relates to a mould for casting concrete and to a method of moulding concrete panels, the panels being particularly useful in a form of modular building construction.

In my British Patent Specification No. 1,109,501 there is described a continuous casting process for industrialised building. My British Patent Specification No. 1,516,679 also describes a core-former for use in the latter continuous casting process and in the present invention.

The normal method for casting concrete panels is to lay heavy steel or other solid side shuttering sections of suitable profile along the length of a casting bed, which sections are then bolted or wedged together to form a continuous long line. Light sections cannot be used as they would soon deflect and create tolerance problems. Whilst this method of preparing the side shuttering is superior to normal moulding box processes, it has the following disadvantages.

(1) Slow assembly due to heavy weight and bolting and wedging.
(2) Side shuttering alignment difficulties.
(3) The side shuttering requires to be cleaned and oiled after each casting.
(4) Care is required when the side shuttering is removed, after partial hardening of the concrete, to avoid damaging the concrete and for the same reason early removal is not possible.
(5) Difficulties in unbolting and removal of heavy side shuttering.
(6) Damage to the casting bed as well as to rubber sleeved core-formers.
(7) Rust and damage leading to inaccuracies.
(8) When narrow panels or floor slabs are cast on the bed, the uncast portion of the bed is wasted whereas the production could be doubled if the side shuttering could be used to cast on both side faces.
(9) Damage to shuttering or to machines such as vibrators, screeders and finishing machines.
(10) The side shutterings create considerable vibrational noise when in contact with the compacting machines.
(11) The step-by-step assembly of side shuttering pieces is laborious and time consuming.

Attempts to improve traditional building techniques and to avoid problems such as those described above have failed to produce any significant advantages over traditional methods. Over a hundred major systems of one sort or another have been developed over the past 30 years but they all have one common characteristic. They all depended on standardization of components to overcome the problem of manufacturing innumerable component variants, which are required even for the smallest non-standard building.

This leads to a restriction in the design of buildings since the complete structures depend on the shape and versatility of the components used in construction. If the number of different components is reduced to simplify the system, then further limitations are normally imposed on building design. Moreover, the problems and disadvantages mentioned above may still be present, because of the use of traditional methods of producing the building components.

The invention seeks to solve the latter problems by providing a concrete mould which has resilient shuttering (for example, made of rubber), which extends between rigid end anchorages on a casting bed. The shuttering and the end anchorages form a casting box for wet concrete. Laterally spaced tensioning wires extend longitudinally of the shuttering and are stretched between the end anchorages to prevent any substantial deflection of the shuttering when the casting box is filled with wet concrete.

The advantages offered by the invention are that:

(1) the assembly of the side shuttering is speedily carried out;
(2) the alignment of the shuttering is facilitated by stretching the tensioning wires;
(3) no cleaning or oiling of the shuttering is required, because wet concrete does not adhere to rubber, for example;
(4) the resilient shuttering does not damage cast concrete and early removal is possible, for example, the rubber shuttering can be easily peeled off;
(5) the resilient shuttering does not damage the casting bed;
(6) wear and tear of the resilient shuttering is minimal, thereby avoiding inaccuracies in tolerance and extending the life of the shuttering;
(7) multiple adjacent casting of concrete slabs is possible, thereby enabling economic use of the casting bed and increasing production yield;
(8) vibrational noise is eliminated; and
(9) time is saved in setting up the shuttering to cast panels of different sizes.

Referring to the use of metal joint formers to separate cast panels and to provide a desired joint profile as described, for example, in British Patent Specification No. 1109501, they are reasonably efficient, but they have the following defects:

(1) They are relatively heavy and are hence not easy to handle.
(2) They are bulky and occupy space when stored outside the casting bed, in between use.
(3) They involve the use of several different sections which need to be bolted or wedged together and then unbolted again after use.
(4) They tend to damage the bed due to their weight.
(5) They are subject to rapid wear and tear due to the severe abrasive, wet and mechanically damaging environment especially when in contact with casting machines.
(6) They tend to damage the casting machines when placed with slight inaccuracies in height such as when a small sand particle gets lodged between the joint formers and the casting bed.
(7) They can be damaged when the panels are separated from each other if the sliding and lifting of the several ton weight of panels is carried out slightly inaccurately.
(8) When different heights of wall panels or different widths of floor panels have to be cast, the metal joint formers must be made in different sizes as they cannot be easily assembled together to give the various heights required. This is because the metal joint formers are heavy rigid sections and extending them in length can only be done by carefully bolting attachments to maintain accuracy and alignment.
(9) They require careful cleaning and oiling after each use. This is a laborious and time consuming process and the work is out of keeping with the industrial process.

(10) They create considerable vibration noise when in contact with the casting machines.

In a preferred embodiment of the invention, a series of core apertures extend longitudinally of the shuttering, i.e. the apertures are provided in each piece of shuttering which forms one of the sides of the casting box. These apertures receive resilient pneumatic core formers as described in UK PS No. 1516679 which pass through aligned apertures in the side pieces of the shuttering and hence through the casting box. Joint formers are located about the core formers on the casting box; each joint former being resilient or part resilient (for example, made of rubber or partly made of rubber) and having grooves transverse to its length to receive reinforcement or tensioning wires.

The joint formers have different profiles and are used separately or in combination to provide slots in the side edges of the concrete panels, or at positions between the side edges of the panels, or to separate panels which are cast adjacent one another on the same casting bed.

The advantages of the joint formers in the preferred embodiment of the invention are that:

(1) they are extremely light and small in section;
(2) an entire joint former system can be made up of only 4 different section profiles to make a range of 12 different vertical and horizontal joints.
(3) waste is reduced;
(4) they do not damage the box;
(5) they do not damage or wear easily and are resistant to dampness, abrasion and vibration.
(6) they do not damage the casting machines when in contact with them;
(7) rubber joint formers are not damaged when the concrete panels are separated.
(8) joint formers for the different heights of panels are provided by simply placing different lengths of rubber joint formers together to make the total length. (The pneumatic core formers to which they are attached provide the necessary rigidity and joint accuracy).
(9) as with the preferred rubber side shuttering of the invention, rubber joint formers need very little cleaning and no oiling prior to use;
(10) as with rubber side shuttering, these joint formers do not create any vibration noise when in contact with the casting machines.

The normal method of making openings in concrete panels is to use opening formers made of rigid heavy sections. These are complex devices and adjustment of size is very difficult. This is because the opening formers must be held very rigidly while casting but must be collapsed into the opening before removal. For this reason variation in sizes and location in the panels are avoided by other manufacturers.

According to another embodiment of the invention, the resilient side shuttering and the resilient joint formers can be used as opening formers for opposite sides of a frame to form a window opening. A modular building system according to the invention combines the resilient side shuttering, the penumatic core formers the resilient and part resilient joint formers and the opening formers. This system provides a moulding box with an interlocking arrangement of cores, side shuttering, joint formers and opening formers which can be fastened together, almost like zips, in precise positions, without using any bolts or metal wedges or ties. There is also no fixing to a base as the total combined weight, as well as the weight of the concrete on the casting portion of the bed, hold the moulding box down tightly against the floor, whilst the resilient side shuttering, the joint formers and opening formers act as waterproof seals to confine the concrete. The pneumatic core formers described in UK PS No. 1516679 are preferred because they keep the mould rigid when they are inflated. Whilst the tensioning wires, which extend longitudinally of the side shuttering, are stretched to prevent any substantial deflection of the shuttering when the mould is filled with wet concrete, the inflated core formers also make a tight fit in the respective apertures in the shuttering and thereby assist in preventing such deflection when the mould is filled and vibrated. The core formers can be expanded pneumatically with a pressure of about 40 lb/sq in (28 Newtons/sq. cm), which is equal to a pressure of about 5,000 lbs (22240 Newtons) exerted outwards to expand the fore formers. Additional pressure will not, however, cause further substantial pressure to be exerted on the side shuttering, because the aperture which receives the core former is dimensioned to provide the correct fit and the core former interlock arrangement prevents further substantial expansion.

Whilst on the one hand, the individual weight of all the components of the moulding box can be considerably reduced to only a fraction of what they are in the prior art, on the other hand, full advantage can be taken of the total combined weight of the assembled moulding box to eliminate any need for bolting and wedging.

Rubber is preferably used for all the shuttering, core formers and joint formers and this can be hard wearing tyre rubber. However, other resilient plastics materials may be used. The invention may also be adapted or used for casting polymer concrete which includes chopped fibres of, for example, polypropylene filament, glass reinforced plastics, or carbon filaments. These materials may also be used as fibre reinforcement, in combination with steel reinforcement, in the form of strings or ropes stretched between the end anchorages of the mould (described above) which employs the resilient side shuttering.

The modular casting system of the invention may be automated. For example, rails may be provided, one on each side of the casting bed, to support a machine for traversing the bed in order to carry out automatic functions such as cleaning and oiling, locating core formers and joint formers as well as opening formers in position, and laying, packing and screeding and finishing wet concrete. This machine is controlled by a computer having suitable software or a program which regards to a digital code designating, for example, the centres of the core former apertures along the length of a piece of side shuttering. Each core former opening represents a module and hence the code number represents the module number. The travel of the machine on the rails and the location of reinforcement cages, joint formers and all other inserts in the modular direction is controlled by a digital counter (on the machine) that counts from one end of the casting bed, from 0, and then continues along the bed. The counter is operated by trip devices, which may be either magnetic, e.g. responding to embedded iron studs along the casting bed, or pneumatic e.g. which operates by following a perforated strip. These trip devices may be attached on one side of the bed where they do not interfere with the preparation work. The machine stops at predetermined digital locations corresponding to the modular positions. Prior to starting (position 0), the machine is loaded with the inserts in placement sequence. The operation is carried out by placing only one type of article at a time. This makes the digital coding simple and fool proof. Reinforcement cages are for instance not mixed with light fitting inserts joint formers or other items. Each insert supplied, other than when it spans the full width of the casting area, is coded with a second co-ordinate (see below) which is required to locate the insert in position relative to the side shuttering. The machine is loaded with the insert in an exact position relative to the second co-ordinate (see below).

Coded holes are also provided at the end anchorages so that concrete panels can be cast with reference to code numbers representing, for example, the width and the height of a wall.

The digital system enables all conventional engineering and architectural drawings, which are usually employed in providing information to personel who carry out continuous casting bed techniques, to be dispensed with. Whilst the digital system is automatic, (i.e. by using magnetic discs or punched tape), the digital coding may also be such that it can be read by operators with regard to locating articles at certain modular positions on the casting bed. In either or both cases, skilled labour is not required, for example, to manufacture and to place reinforcement wires or rods on the casting bed.

In the case of either an automated, or non-automated continuous casting procedure, standard reinforcement cages can be located in the moulding box at the modular positions corresponding with the core former apertures in the resilient side shuttering. These cages can first be located between upper and lower runs of reinforcing wires, stretched between the end anchorages of the moulding box, and the cages can be subsequently secured in position by introducing joint formers and then the pneumatic core formers which are expanded to lock each cage in position. Similarly, the joint formers, opening formers as well as all other inserts are located with reference to the modular positions. In the case of opening formers and other inserts, which do not run the full width of the casting space, a second co-ordinate is required to position the items along the modular positions. This second co-ordinate is given in the coding for the item itself. For instance, an opening former, representing a window, will have a second co-ordinate representing the head height of the window. Similarly an insert for an electrical fitting may have a centre line co-ordinate. These second co-ordinates represent the top height of the window and the centre line of the light fitting from the floor level and may be used as code numbers on the supplied items. When a machine is used to position inserts in the bed, the various items are located on the machine in exact position with reference to the co-ordinate along the width of the bed. The machine need therefore be given only the modular co-ordinate to position the various reinforcement cages, joint formers, opening formers and other inserts along the full length of the bed. Besides the advantage that skilled labour is not required to interpret drawings drawings as in conventional practice, the technique according to the invention reduces the time and costs of manufacturing reinforced concrete panels.

Specific details of the digital system for the automatically deriving the digital code from building designs is not given as it is essentially software. However, the digital system can cater for one off production of several different housing designs per day whereby for production can be rapidly transferred accurately and simply and production times are much faster with substantial savings in manufacturing costs.

The different advantages and features of the invention will become more apparent from the following description of certain preferred embodiments which are described with reference to the accompanying drawings, in which.

Figure 4:
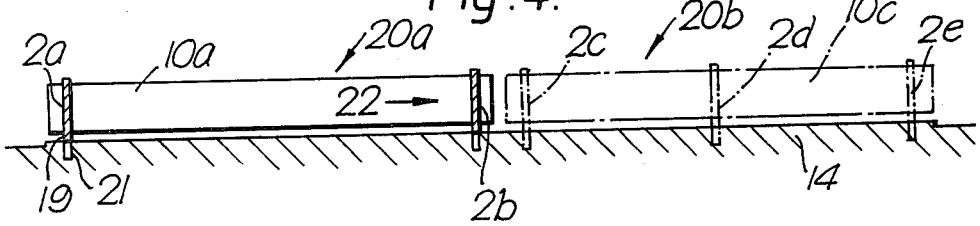

FIG. 4 schematically illustrates two moulds side-by-side on the same casting bed.

FIGS. 5–7 show different ways of supporting the side shuttering with tensioning wires.

FIG. 8 shows one technique for embedding the tensioning wires in concrete.

FIGS. 9 and 10 schematically illustrate how the shuttering may be used (with reference to FIGS. 5, 6 and 7).

Figure 11:
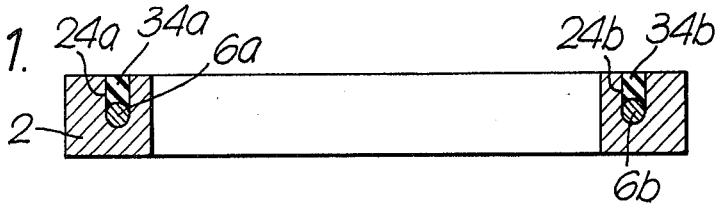

FIG. 11 illustrates one technique for inserting wires in the shuttering.

Figure 12:
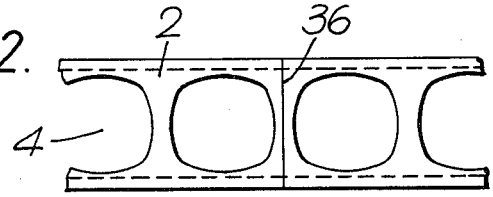

FIG. 12 illustrates how adjacent pieces of shuttering can be joined.

Figure 3:
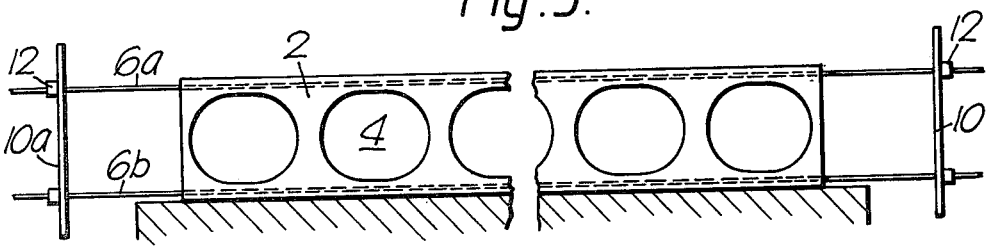
FIG. 3 is an enlarged view, in side elevation, of rubber side shuttering having a series of core apertures along its length, the figure also showing tensioning wires which support the shuttering and which are fixed to the end plates.
Figure 13:
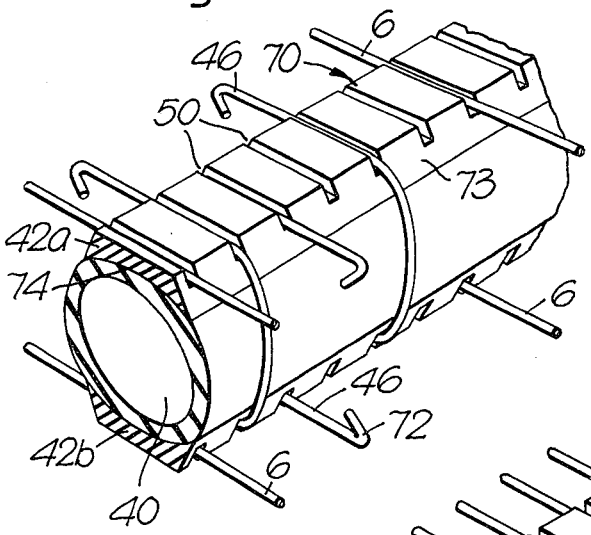
Figure 14:
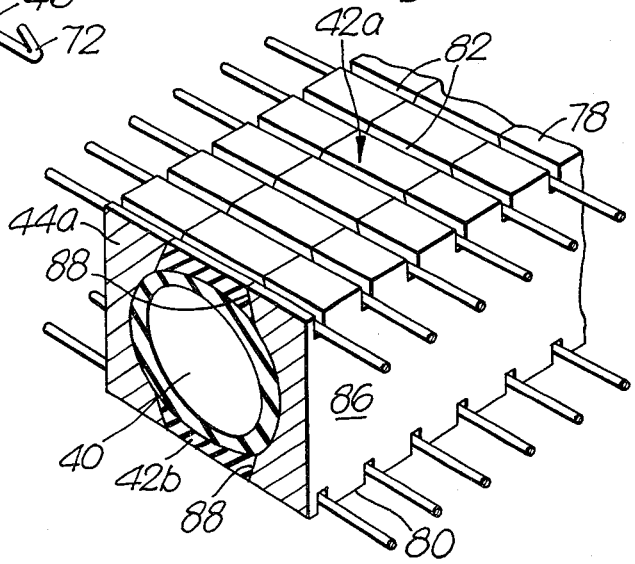
Figure 15:
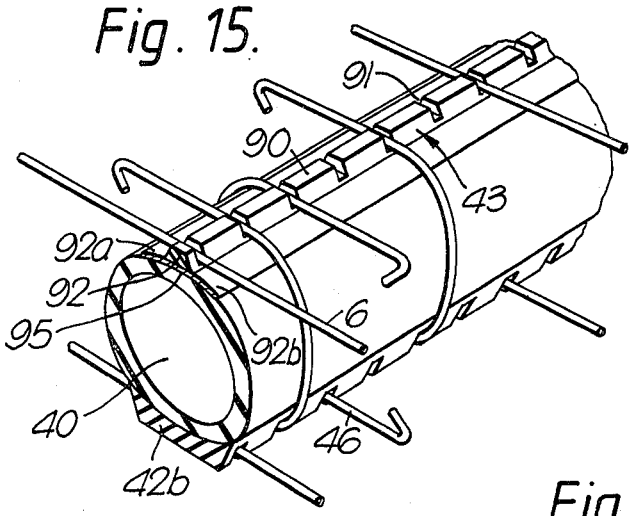

FIGS. 13, 14 and 15 illustrate different types of joint formers and shows how they are fitted to reinforcing wires extending between the end plates and to core formers received in core apertures in the shuttering shown in FIG. 3.

Figure 16:
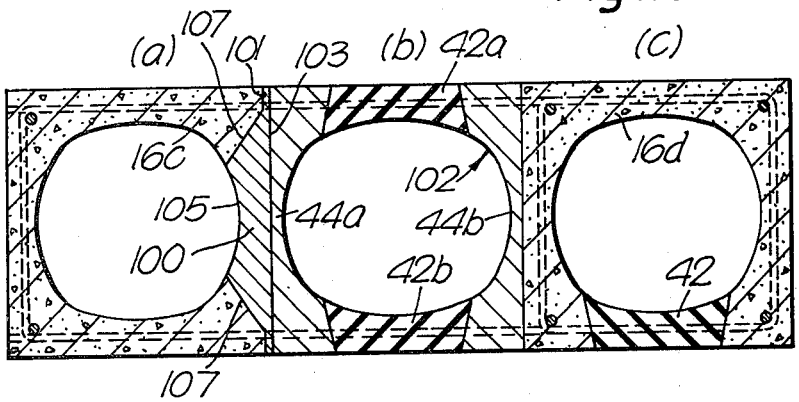
Figure 17:
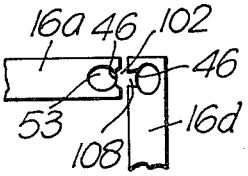
Figure 18:
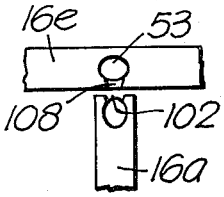

FIG. 16 is a section showing the use of some of the joint formers of FIGS. 13 and 14 and another type of joint former which acts as end shuttering.

FIGS. 17–20 are diagrams to show how panels made with the aid of the joint formers are joined in different ways.

Figure 21:
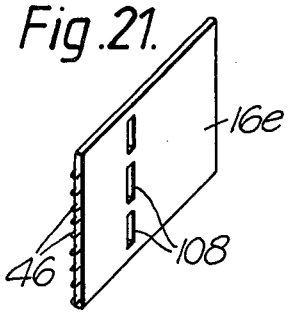

FIG. 21 is a diagram for further explaining how the joints are made.

Figure 22:
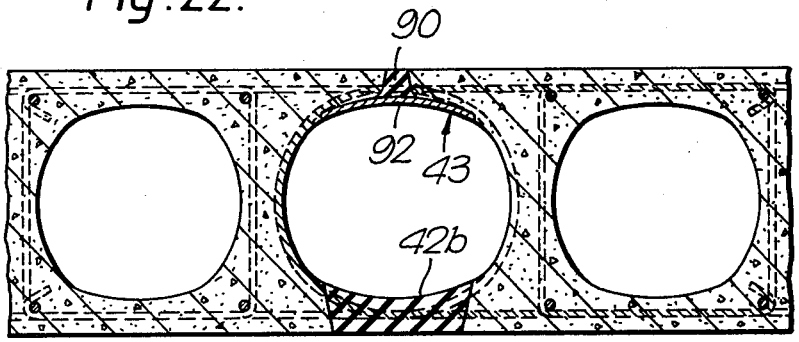

FIG. 22 is a section showing the use of the joint formers of FIG. 15.

Figure 23:
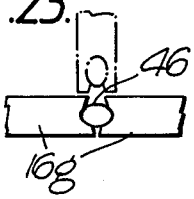
Figure 24:
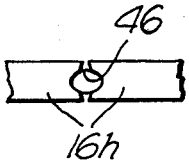
Figure 25:
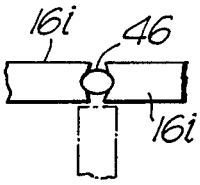

FIGS. 23–25 are diagrams showing how how joints can be made.

Figure 26:
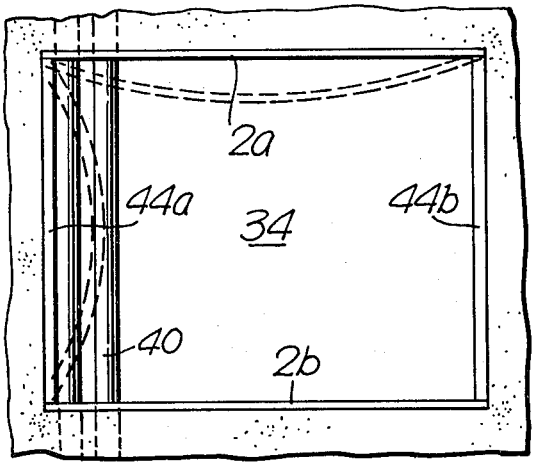

FIG. 26 illustrates how the joint formers are used to make an opening former.

Figure 27:
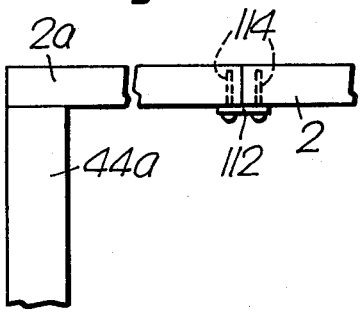
Figure 28:
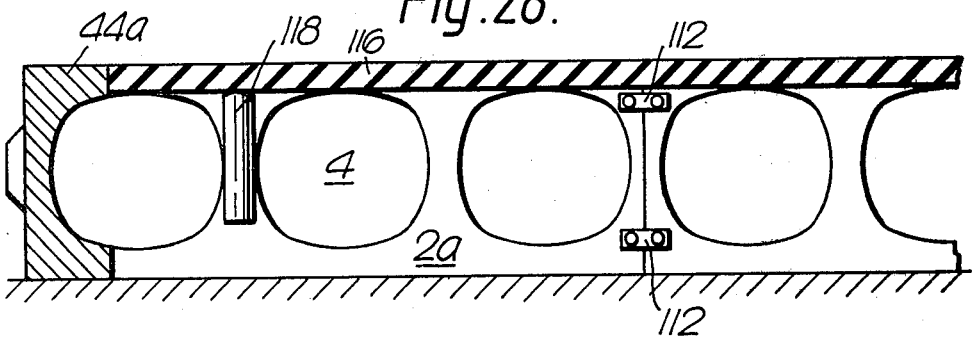

FIGS. 27–28 show details of the opening former.

Figure 29:
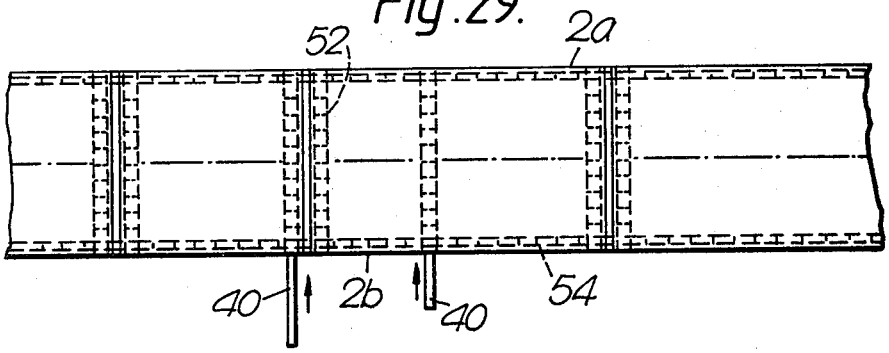

FIG. 29 is a plan view of the casting bed to illustrate the use of standard reinforcement cages and the insertion of core formers.

Figure 30:
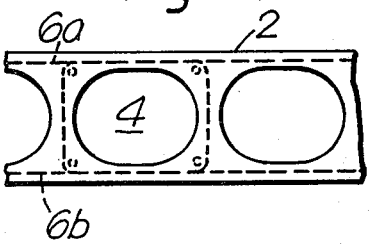

FIG. 30 is an elevational view to show a detail of the cages.

Figure 31:
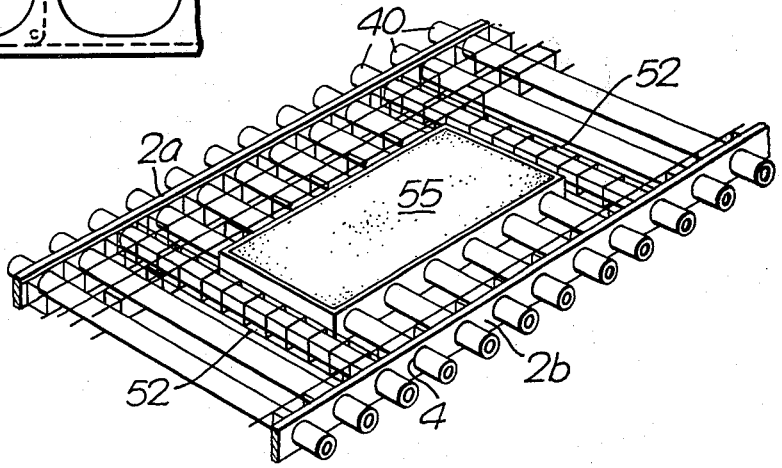

FIG. 31 is a perspective view of part of the concrete mould with an opening former.

FIGS. 32–33 show different panels cast in moulds according to the invention.

Figure 34:
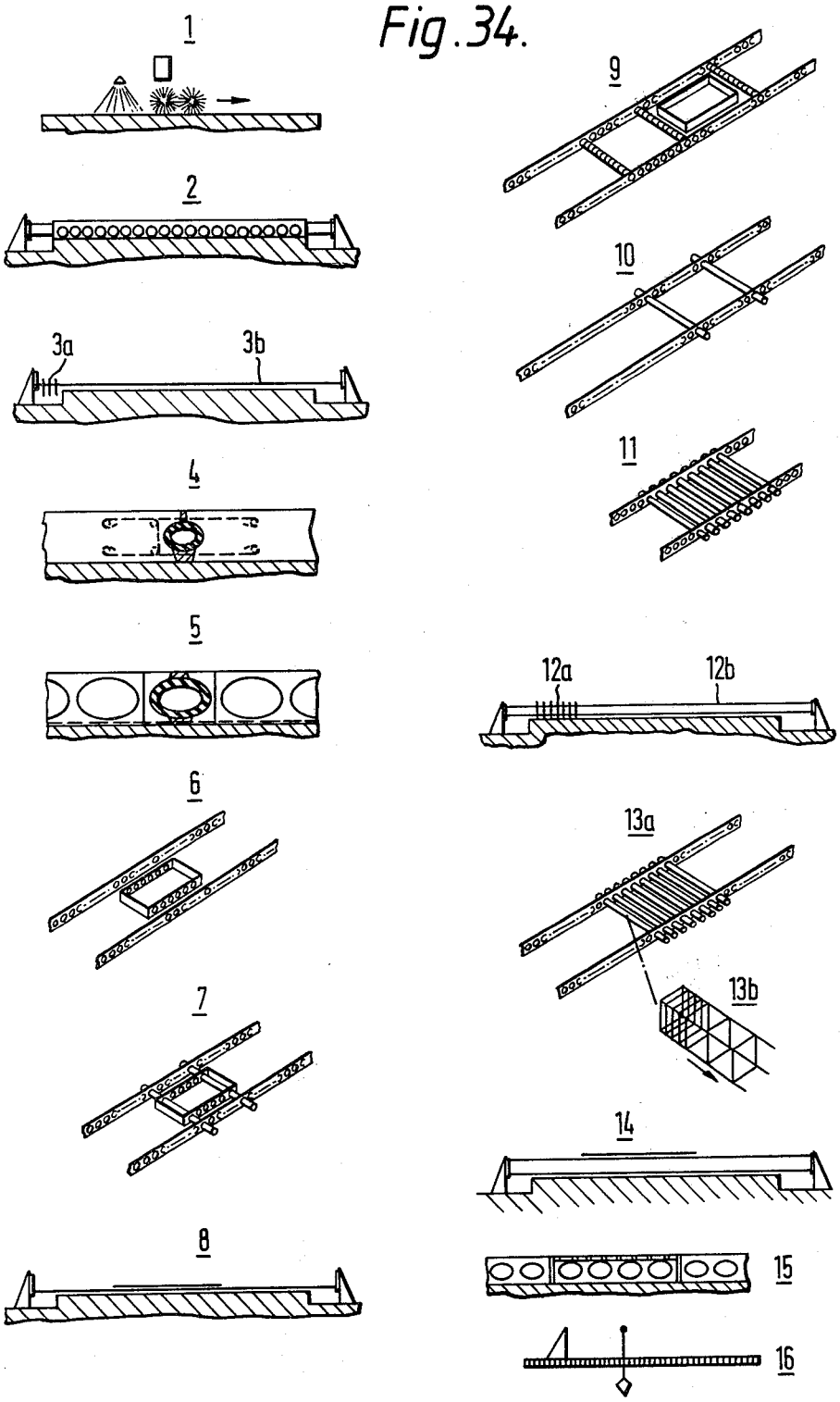
Figure 35:
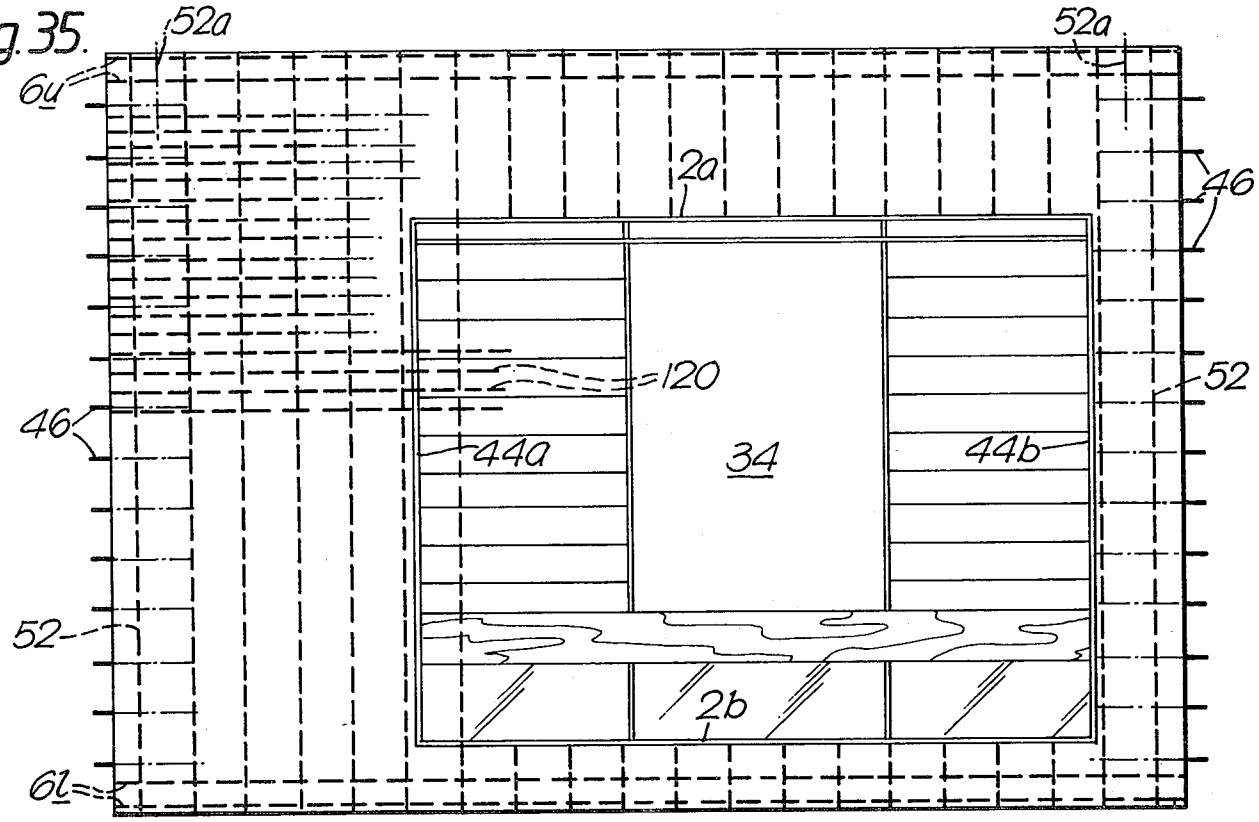
Figure 36:
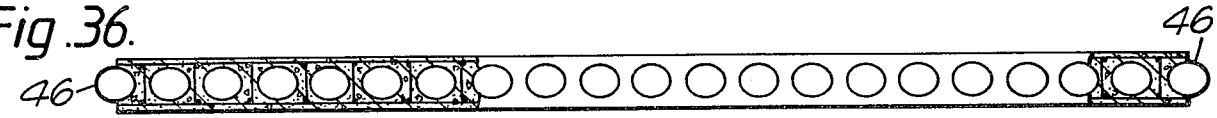
Figure 37:
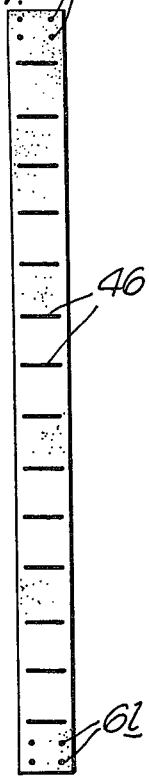

FIG. 34 shows a series of schematic diagrams illustrating a technique of the invention, and, FIGS. 35–37 are respective plan, end elevational and side elevational views of a panel produced according to the invention.

FIGS. 3 and 4 generally illustrate a casting bed 14 for casting prestressed concrete panels. The bed supports one or more concrete moulds each comprising resilient shuttering 2 (as side pieces 2*a*, 2*b*), rigid end anchorages 10 (as end plates 10*a*, 10*b*), and tensioning wire 6 (where respective wires 6a, 6b are spaced apart in a piece of shuttering 2 and extend along its length).

Figure 1:
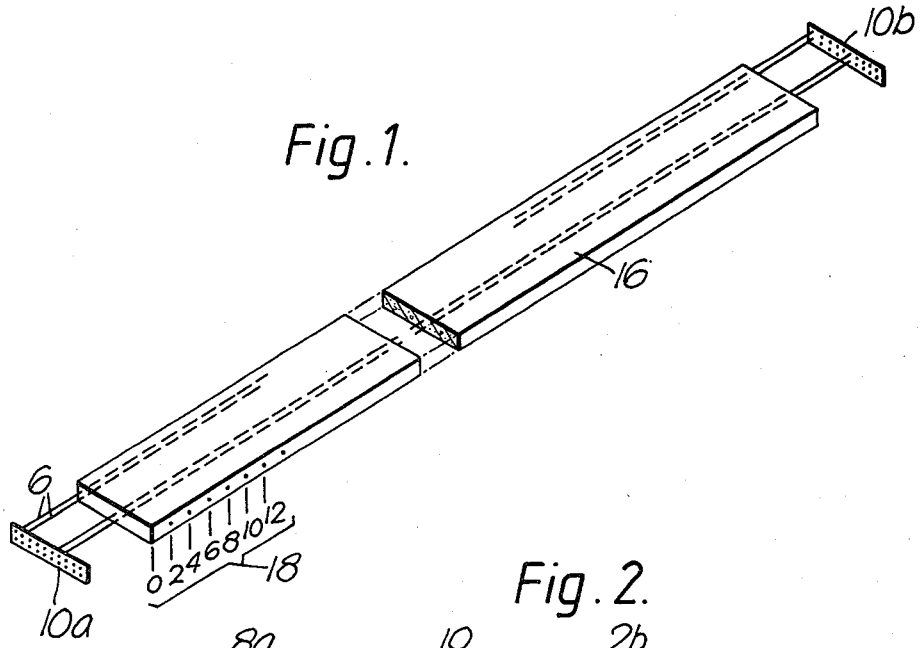
FIG. 1 is an isometric view of a concrete panel which has been cast in a mould having end plates which may be fixed to a casting bed.
Figure 2:
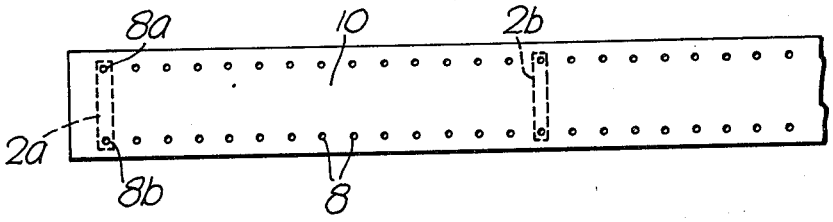
FIG. 2 is an elevation of one of the end plates.

The mould, without the side shuttering in position and without the necessary casting bed, is schematically illustrated in FIG. 1. The end plates 10a, 10b are secured to the casting bed so as to form the ends of the mould and so as to provide anchorage for tensioning wire 6. A concrete panel 15, which may be used as the bed 14, is also schematically illustrated in FIG. 1, although this would extend, when cast, up to each end plate 10a, 10b. The length of panel 16 may be approximately 120 meters and its width approximately 8 meters. A series of reference digit codings 18, are provided on the bed in positions at which core formers can be inserted in the mould before pouring the concrete. The purpose of the core formers is explained below, although it is noted here that the reference digits code the core former positions with regard to a modular system of casting concrete panels 16. One of the rigid end plates 10, which is made of steel, is shown in detail of FIG. 2. It has a series of holes 8 through which the tensioning wire 6 can be threaded. One piece of shuttering 2a is spaced from a second piece of shuttering 2b (as indicated by the broken lines) to form the sides of the mould. The holes 8a, 8b adjacent the side shuttering 2a receives tensioning wires which extend along the length of the side shuttering 2a and which are tensioned (between the end plates 10a, 10b) to prevent any substantial deflection of the shuttering when the mould is filled with wet concrete. The spacing between the holes 8 is constant, for example, 25 mm so that concrete panels can be cast having different widths which are multiples of the hole spacing.

As shown in FIG. 3, each piece of side shuttering 2 has a series of core former apertures 4, the centres of which are aligned with the respective digit 18 on the casting bed when the shuttering 2 is secured between the end plates 10a, 10b. The shuttering 2 is made of rubber and it may be sufficiently strong to locate wires 6a, 6b in respective upper and lower grooves (as shown, for example, in FIG. 7). The ends of wires 6a, 6b pass out through holes 8a, 8b in the end plate 10 and are tensioned by conventional jacks (not shown) before being secured, under tension, by conventional fittings or clamps 12.

FIG. 4 schematically illustrates adjacent concrete moulds 20a, 20b on the same casting bed 14, the mould having respective end plates 10a, and 10c across, for example, an 8 meter width. The end plates have feet or pegs 19 which are received in apertures 21 in the casting bed 14. When using two moulds as shown in FIG. 4, the same core formers (not shown) can be used in a first casting in mould 20a, and subsequently moved, in the direction of the arrow 22, into second mould 20b for a second casting. The manner by which this is achieved will be apparent from the following description and from the description of the preferred core formers in U.S. Pat. No. 1,516,679, the core formers being received in the apertures 4 in shuttering 2.

FIGS. 5–7 illustrate different ways in which the tensioning wire 6 can be used to prevent substantial deflection of the side shuttering when the mould is filled with wet concrete.

In FIG. 5, tensioning wires 6a, 6b are received in respective holes 7a, 7b passing through the length of the side piece of shuttering 2. The wires may be inserted through the holes, or covered with rubber when the rubber shuttering 2 is moulded, or made in accordance with the method described below with reference to FIG. 11.

In FIG. 6, tensioning wires 6a, 6b and 6c, 6d are stretched adjacent the respective side faces of the side shuttering 2. In this case, the wires may be removed from the wet concrete when the shuttering is a common wall to adjacent moulds.

In FIG. 7, tensioning wires 6a, 6b are located in respective grooves 24a, 24b. In this case, when concrete is cast on the grooved side of the shuttering 2, the shuttering may be removed in the direction of arrows 26, leaving the wires 6a, 6b in place, and a second casting may be made, adjacent the first, to embed the wires 6a, 6b. This is illustrated in FIG. 8, wherein the broken line 26 represents the join between the first and second castings 28, 30. The arrangements shown in FIGS. 5, 6 and 7, which will be designated a types A, B and C, may be used for casting concrete on either one, or both faces of the shuttering 2. This is illustrated schematically in FIGS. 9 and 10 where the different types A, B or C are used as side shuttering in adjacent moulds. With type B, the wire 6 may be removed on one, or both sides of the shuttering 2 when the shuttering forms a common wall between adjacent moulds, the wire being removed before the concrete sets. Reference numeral 30 represents joint formers which are described below and reference numeral 32 represents opening formers (which are also joint formers) also as described below. The opening formers define an opening 34 in a cast panel. The type A arrangement is preferred for continuous lengths of cast panels, the type B arrangement is preferred for non-continuous medium lengths to divide sub-widths and the type C arrangement is preferred for making openings 34. FIG. 11 illustrates a section of shuttering 2 in which wires 6a, 6b are received in grooves 24a, 24b. The wires are sealed in the respective grooves by strips of rubber 34a, 34b which are vulcanised to the walls of the grooves. FIG. 12 illustrates adjacent lengths of shuttering 2 which are vulcanised together at a seam 36 to make a continuous length.

FIGS. 13–15, illustrate different types of joint formers which may be used so as to form slots in the concrete panels cast in the mould, or to enclose core formers 40, made of rubber, which are introduced through aligned apertures 4 (see FIG. 3) in opposite pieces of side shuttering 2 so as to separate adjacent panels which are cast on the same bed. These joint formers are used in different assemblies and arrangements (as will be described below with reference to FIGS. 16–25), to provide concrete panels, such as wall floor and ceiling panels, which can be joined together to form a structure.

Referring in general to FIGS. 26–28, the panels may have openings 34 (for example, to receive windows). The method of forming these openings is described below in detail.

FIGS. 29–31 show how the core formers 40 are introduced through aligned apertures 4 (see FIG. 3) in opposite pieces of side shuttering 2a, 2b. FIG. 29 shows how standard reinforcement cages 52 are introduced between aligned core apertures 4, the cages resting on tensioning wires which extend between respective end plates (not shown in FIG. 29, but see FIG. 1). The core formers 40 are threaded through the cages 52 after the cages have been secured in place. Additional standard binders or cages 54 may also be introduced alongside the inner surface of each piece of side shuttering 2a, 2b. Cages 54 are arranged and secured in the mould before introducing core formers 40 and so as not to obscure the apertures 4. FIG. 30 schematically illustrates how a cage 52 is located between tensioning wires 6*a*, 6*b* and is centered with respect to the aperture 4 in the side shuttering 2.

FIG. 31 schematically illustrates a typical mould wherein a plurality of core formers 40 (some of which are threaded through cages 52) extend through aligned apertures 4 in opposite pieces of side shuttering 2*a*, 2*b*. The figure also shows a region 55 which represents a covered opening (see the technique described below with reference to FIGS. 26–28). The process of casting concrete panels generally involves pouring wet concrete into the mould and settling the core formers, cages, formers, etc by conventional vibrating techniques. As the concrete does not adhere to rubber, when the concrete has set the side shuttering 2 and the formers 40 can be easily be removed. This results in a concrete panel having a series of parallel tubular cavities 53 across its width, as shown for example in FIGS. 32 and 33.

The panel shown in FIG. 32 may be used as a floor or roof slab and it has a series of reinforcement members 6*c*, similar to the tensioning wires 6*a*, 6*b* (FIG. 3) and made of steel, or made of non-ferrous material, such as polypropylene (ie in the form of strings or ropes). Members 6*c* extend at spaced intervals across the width of the panel and a series of reinforcement cages 52, which were previously located to correspond with alternate core former apertures 4 in the side shuttering of the mould, extend at spaced intervals along the length of the panel.

FIG. 33 shows an upper panel 56, which forms a horizontal cantilever resting on a lower vertical panel 58. The tensioning wires 6 extend at spaced intervals across the width of panel 56, as in the case of the panel shown in FIG. 32, and reinforcement cages 52 are provided at the end of panel 56 and at a position at which a panel 56 rests on the upper edge of the lower panel 58. Cages 54 also extend on the side edges of the panel 56. A more detailed description will now be given of how the joint formers are used to finish the panels so that they may be either joined together either edge-to-edge, or at right angles to one another, or separated when cast on the same bed.

FIG. 13 shows two of the same type 42 of joint former 42*a*, 42*b*, which are applied to the top and bottom portions of the core former 40 to provide a respective slot or a series of slots 108 in the cast panel (see description of FIGS. 16–22 below). In the case of providing of slots, the joint formers 42*a*, 42*b* are each one of a series extending at spaced intervals across the width of the mould. The joint former type 42 is made entirely of rubber and has a first face 70 in which a series of parallel grooves 50 are provided. Some of these grooves receive tensioning or reinforcement wires 6, which are secured to the end plates 10*a*, 10*b* (not shown, but see FIG. 1) and which extend along or between the side shuttering 2. Other grooves 50 receive ties 46, in the form of steel wires or rods, which are taken around the upper and lower joint formers 42*a*, 42*b* and the core former 40. Free ends of the ties 46 may be bent, as shown by reference 72, and secured to adjacent steel cages or joint formers. Opposite the face 70 of each joint former 42*a*, 42*b* is a concave face 74 which is shaped to conform with the contour of the respective part of the core former 40. The ends of the joint formers 42*a*, 42*b* have a wedge-shaped or tapering cross section between inclined side faces 73. After tensioning the wires 6 between the anchor plates 10*a*, 10*b*, the joint formers 42*a*, 42*b* may be fitted, almost like zip-fasteners, to the respective wires 6. The core formers 40 are then introduced and the ties 46 are applied as shown.

Referring to FIG. 14, side formers 44*a*, 44*b*, which are of a different type 44, are almost completely made of rubber and have opposite faces 78, 80 each provided with a series of parallel grooves 82 which can be aligned with the grooves 50 in the upper and lower formers 42*a*, 42*b*. Each side formers 42*a*, 44*b* also has an outer side face 86 opposite to which is an inner concave face 84 which is shaped to conform with the contour of the respective portion of the core former 40. Inner edge parts 88 of each side former are also inclined so as to correspond with the respective tapered portion of the upper and lower former 42*a*, 42*b*. The type 44 joint formers are used in combination with the type 42 joint formers for totally enclosing the formers 40 where it is required to separate panels cast on the same bed (see description of FIG. 16).

FIG. 15 illustrates another type of joint former 43, which is partly resilient and which consists of a narrow strip 90 made of rubber with corresponding grooves 91 (similar to those shown in FIGS. 13) along its length. The resilient rubber strip 90 is attached to a rigid base 92, made of glass fibre or metal, with flanges 92*a*, 92*b* extending on either side of the strip 90. The base 92 has a concave face (95) which is shaped to conform with a respective part of the core former 40. The tensioning wires 6 and the ties 46 are the same as those described with reference FIG. 13. Also shown in FIG. 15 is a lower joint former 42, of a similar construction to that shown and described with reference to FIG. 13.

The pneumatic core formers 40 can be expanded, by inflation, as described in UK PS No. 1516679, whereby they secure the upper and lower joint formers in the required positions on the tensioning wire 6.

FIG. 16 illustrates how the joint formers, including another type of joint former acting as a form of end shuttering 100, can be used in casting concrete panels which can be joined to form a right-angled corner joint, a "T" joint and a cross or four-way joint as shown in FIGS. 17–20. The joint former or end shuttering 100 has a pair of longitudinally extending side flanges 101 each provided with a series of parallel grooves 82, not shown in FIG. 16(*a*) but similar to the grooves 82 in the joint former 44 of FIG. 14. The joint former 100 has a plane face 103 opposite a concave face 105 flanked by tapering portions 107 extending between the concavity and the respective side flanges 101.

FIG. 16 is a cross-sectional elevation of a part of a concrete mould in which end shuttering 100 is used in section (a); a joint former assembly 102, similar to that shown in FIG. 14, is used in section (b); and joint formers of type 42 are used in section (c). Use of the joint former or end shuttering 100 provides openings 102 in the side edges of the panels 16*a* schematically illustrated in FIGS. 17–20. Opening 102 communicate with the tubular cavities 53 in the panels which are adjacent the respective side edge. Panels 16*a* form part of the corner, "T", and cross joints shown in FIGS. 17, 18 and 19 and they form the four members of a cross joint in FIG. 20.

The assembly 102 shown in section (b) of FIG. 16 is used to separate panel 16*c* of section (a) from panel 16*d* of section (c). In this case the joint formers 42*a*, 44*a*, 44*b* form an assembly 102 which totally encloses the core formers 40 (not shown) across the width of the mould.

Figure 19:
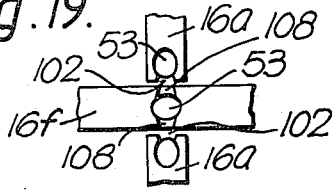
Figure 20:
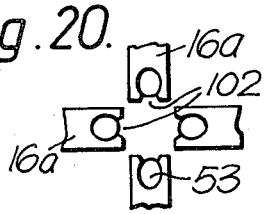

The joint formers 42 used in section (c) of FIG. 16 enable a slot or a series of slots 108 to be made across the width of a panel 16*e* as schematically illustrated in FIG. 21. In the latter case, the joint formers 42 are spaced at intervals along the length of the core former 40 (not shown) across the mould. As shown in section (c), the joint formers 42 (only one of which is seen) are located adjacent the side edge of panel 16*d*. This provides corresponding slots 108 as shown in panel 16*d* of FIG. 17. However, the joint formers 42 can also be positioned between other aligned apertures 4 (not shown) in the side shuttering 2 (not shown) to provide a slot or a series of slots 108 at intermediate positions. This is shown in panels 16*e* of FIGS. 18, 19 and 21. In FIG. 19, upper and lower joint formers 42*a*, 42*b* (see FIG. 13) have been used to provide an upper and lower series of slots 108 in the panel 16*f*. FIG. 21 illustrates a concrete panel 15*e* wherein the ties 46 protrude from one edge as a series of U-shaped members (after removing end shuttering 100). The slots 108 are required to make the "T" joint between panels 16*e* and 16*a* shown in FIG. 13.

The joints between the respective panels shown in FIGS. 17–20 may be made by using a concrete infill according to the technique described in British Patent Specification No. 1109501. Hence no detailed description need be given of that technique.

FIGS. 22–25 illustrate similar techniques for making a "T" joints (FIGS. 22, 23), edge-to-edge joints (FIG. 24) and a floor-to-floor joint (FIG. 25) by employing the joint formers 90 and 42*b* as shown in FIG. 15. The joint-forming parts of the concrete panels 16*g* shown in FIGS. 22 and 23 are made by using joints formers 43 and 42*b*. Two joint formers 43 are used, top and bottom, to provide the panels 16*h* shown in FIG. 24 which can be joined edge-to-edge. Two joint formers 42*b* are used at, top and bottom, to provide the panels 16*i* shown in FIG. 24 which form a floor-to-floor joint with a wall 110 (indicated by the broken line). FIG. 26 is a plan view showing how the rubber side shuttering 2 and the type 44 joint formers are employed to form an opening in a concrete panel. The broken lines represent how the shuttering and joint formers are flexed away from the edges of the opening in the panel once the concrete has set. Some of the core formers 40 passing through the opening 34 are also illustrated.

FIG. 28 illustrate the use of double-peg jointing pieces 112, each provided with a pair of pegs 114 which are received in corresponding apertures in the side shuttering 2 for joining respective lengths of shuttering 2 edge-to-edge. FIG. 28 illustrates how a flexible cover 116, made of rubber, is fitted over the frame formed by the shuttering 2 and joint formers 44 of FIG. 26 before the concrete is poured. The cover 116 is provided with pegs 118 which fit between respective core formers introduced through the apertures 4 in the side shuttering 2.

The moulding box technique described above could be used with traditional reinforcement design and placement methods but a further improvement is possible as described below. The usual method of making reinforcement for wall slabs is in the form of flat mats which are prepared by welding or tying bars together in the correct position. Usually a jig is used to prepare the different reinforcement mats and this is a time consuming and laborious process. The drawings from the engineer have to be first interpreted, then the bars cut to size followed by the welding or tying of the bars together to get a suitable mat to fit a particular panel, the mats would have to be made with cut outs for windows and doors and would also incorporate projecting ties.

There is no way in which this work can be done without taking days even for a simple building. Furthermore when the reinforcement is placed in the moulds, it is difficult to handle due to its lack of rigidity and the reinforcement itself has to be held in place by supports to keep it at the suitable height from the mould base.

Spacers have also to be used to keep the reinforcement in the correct position relative to the sides. After all this preparation is done there is no guarantee that the reinforcement has not moved during casting of the concrete. An improved reinforcement technique will now be described with reference to FIGS. 35–37 which can be used for all panel designs without any prior preparation of special steel work.

In this process, which employs the mould of the invention, the main steel wire 6 is drawn from the end anchorages along the full length of the bed. A lower run of steel 61 is first drawn and after anchoring on each side, the steel is stretched similar to stressing wires used as prestressed wires. Non-ferrous or ferrous reinforcement 120 is also drawn between the end plates (which is subsequently cut out of window openings 34).

Following this, standard mechanically prepared rigid cages of steel reinforcement 52 are placed all along the bed at selected centres 52*a*.

An upper run of steel 6*u* is then stretched from the end anchorages, while the rest of the work such as placement of door and window opening formers 2*a*, 2*b* 44*a*, 44*b* and joint formers is carried out. The joint formers are also introduced into the steel cages and the core formers are then threaded through the joint formers in the cages and expanded to lock all the moulding box sections and the steel reinforcement together.

Additional steel loops 46 are clipped on to the end of the panels to form the vertical joints between the walls. The bed is now ready for casting.

The reinforcement technique described above has the following advantages:

(1) No prior preparation of steel work is required.

(2) It is a simple, quick, accurate and efficient technique to stretch the top and bottom reinforcement wires between the end anchorages.

(3) Exactly the same technique is used for the casting of floor and roof panels.

(4) Some plastics, like polypropylene fibrillated fibres, can be used (as known) partly or wholly to replace steel in certain types of concrete elements. Polypropylene fibre reinforcement is usually employed in the form of chopped fibres of short length, mixed with the cement matrix. The disadvantages of this method are that chopped fibres tend to bunch up; the fibres may surface and effect finishing operations; filaments are dispersed throughout the mix and hence are randomly placed not only where they are most required but also everywhere else. This reinforcement technique (see, for example, British Patent Specification No. 1,130,612) may thus not be used except where the disadvantages can be accepted. (The non-ferrous reinforcement 120 shown in the embodiment of FIG. 36, such as polyproplyne filament, is used by stretching the filament strings between the end anchorages. This has advantages over the chopped fibre method in simplifying the work involved; enabling the same equipment and technique to be used as for the steel wires and the filament; enabling the filament to be precisely located; and to permit a reduction of, for example, the outer face of concrete of the hollow panel sections to less than 25 mm, thereby reducing the overall weight and cost;

(5) High cost materials such as polymer concrete can be used more efficiently as the face thickness of hollow sections can be reduced, provided some amount of fibre such as fibreglass or polypropylene is introduced in the thinnest part of the sections. The most practical way to do this is by the method described.

Referring to FIG. 35, this shows 16 schematically illustrated stages, indicated by numbers in circles, which correspond with stages in the following table wherein the designation "autolock" indicates a machine which travels along the rails to a point at which the joint formers, ties and cages are deposited on the casting bed so that they may be assembled (as described above).

When casting panels which are intended for a modular form of building construction, automatic placing equipment can locate the reinforcement, cores and joint formers angles to the direction of the casting bed by reference only to the reference digit codings 18 (see FIG. 1) which indicate the positions of the centres of the core-former apertures 4. The use of these reference digit codings 18 avoids certain of the usual engineering drawings used in known casting bed techniques because the information for casting a particular component can be given in the form of a simple code related to the digits on the casting beds and the standard cages to be used. No reference need be made to the particular wall, roof or other elements being cast. Thus, skilled labour would not be required to manufacture, or to place the reinforcement and all types of loading conditions can be catered for without changing the manufacturing technique for any type of component. Identical manufacturing techniques and equipment are used for manufacturing normally reinforced wall panels, columns, beams, floor/roof panels as well as prestressed floor/roof panels and wall panels. The same technique is also used for manufacturing polymer concrete products which are reinforced with steel or non-ferrous reinforcement.

Another method is now described for preparing reinforcement in the bed which is mainly suitable for floor and roof panels but may also be used for wall slabs without openings.

In this process instead of using cage reinforcement across the bed a "ladder" reinforcement is used instead. The main steel wires 6 are anchored to one end anchorage and unwound along the full length of the bed from coils fitted on to a moving trolley running along the length of the bed.

Prior to anchoring however the cross reinforcement "ladders" are first suspended on edge on a dispenser trolley that can eject one ladder at a time at positions lying between core former positions. The trolley runs along the length of the bed following behind the first trolley carrying the coils of wire.

The main wires are threaded although the entire stack of "ladder" reinforcement before being anchored to one end anchorage.

The trolleys one and two now follow each other directly behind the clearing machine. As the main wires are unwound the "ladder" reinforcement is ejected one at a time on to the stretched main wires. The exact locations are determined by following the modular numbers which can be counted off from the start at 0 by sensing simple magnetic trip sensors located at modular centres embedded on one side of the casting bed. The "ladders" are laid out on the dispenser in sequence so that the correct "ladder" falls in the right place.

The joint formers are now threaded in from the sides between the top and the bottom reinforcement.

The side shuttering is placed after all the previously cast panels are lifted off the bed, additional joint reinforcement are clipped on, the core formers are threaded in and casting is commenced.

The advantages of this "ladder" reinforcement method are as follows:

(a) A simple small continuous welding machine similar to that used for producing welded mesh fed with steel wires can automatically produce the standard ladder reinforcement to very accurate dimensions, on the same day of casting at very high speed, as no bend of reinforcement is required.

(b) The ladder reinforcement is easy to handle and place as they occupy very little space when bunched together and as each piece is very light in weight.

(c) Due to the compactness of the reinforcement, the entire "ladder" reinforcement for the total bed can be stacked together on the dispensing machine.

(d) The "autolock" dispensing machine can be a simple device sequencially operated by a trip device on the bed.

(e) The main advantage of this "ladder" reinforcement is that work can commence in one single sequence immediately following lift-off of previously cast panels without waiting for the bed to be completely cleared.

The table referred to above, in connection with FIG. 35 now follows:

Check List & Time/Labour/Cost Chart

| Details of Stage | Labour: Man Hours | Labour: Rates | Stage No. | Automatic Machines on Rails | Estimated Labour Cost |
|---|---|---|---|---|---|
| Clean bed and spray with release agent | | | Stage 1 | autoclean clean bed and oil | |
| Lay side shuttering in place and stretch | | | Stage 2 | | |
| Thread stirrups. | | | Stage 3a | | |
| Lay bottom reinforcement and stretch | | | Stage 3b | | |
| Locate joint formers in position together with tie bars and cages | | | Stage 4 | autoclock locate by module and drop items | |
| Locate O-formers at | | | Stage 5 | | |

-continued

| Check List & Time/Labour/Cost Chart | | | | | |
|---|---|---|---|---|---|
| | Labour | | | Automatic | Estimated |
| Details of Stage | Man Hours | Rates | Stage No. | Machines on Rails | Labour Cost |
| joints and expand | | | | | |
| Lay opening formers in position | | | Stage 6 | autoclock locate by module and drop items | |
| Lay two side O-formers in place at each opening form and expand. | | | Stage 7 | | |
| Lay additional special bottom reinforcement where required | | | Stage 8 | autolock locate by module and drop items | |
| Lay reinforcement cages in modular position | | | Stage 9 | autolock locate by module and drop items | |
| Lay O-formers to take electrical or other inserts and expand. | | | Stage 10 | autolock locate by module and drop items | |
| Insert other O-formers and expand | | | Stage 11 | | |
| Thread stirrups. | | | Stage 12a | | |
| Lay top reinforcement. | | | Stage 12b | | |
| For floor/roof slabs, clip on additional stirrups where top reinforcement occur | | | Stage 13a | | |
| slide on stirrup reinforcement binders at all modules adjacent to slide shuttering | | | Stage 13b | | |
| Lay additional special top reinforcement where required. | | | Stage 14 | autolock locate by module and drop items | |
| Covering all openings | | | Stage 15 | autolock as above | |
| Check location and accuracy of: - 1. Side shuttering 2. Joint formers 3. Opening formers 4. Inserts 5. Reinforcements | | | Stage 16 | | |
| Commence casting | | | Stage 17 (not illustrated) | | |

I claim:

1. A mould for casting concrete panels on a casting bed, the mould including end members and side members which form a casting box for casting at least one concrete panel, characterized in that said side members are pieces of shuttering (2) made of resilient material, and that said end members are rigid end anchorages (10) for receiving tensioning members (6) which extend between said end anchorages (10) along the length of said shuttering (2) to prevent any substantial deflection of said shuttering (2) when the casting box is filled with wet concrete, said tensioning members forming lateral supports for said shuttering and there being at least two tensioning members for each shuttering, a series of core former apertures provided along the length of each side member of the mould, and in which respective resilient and pneumatic core formers (40) are received in said apertures, and one or more resilient or part-resilient joint formers (42, 43, 44) are positioned adjacent respective portions of selected core formers (40), each of said joint formers (42, 43, 44) having a series of grooves (50, 82, 91) transverse to its length, said grooves (50, 82, 91) respectively receiving said tensioning members (6), or ties (46).

2. A system according to claim 1 characterized in that said shuttering (2) is used to form a part of a frame within the mould to provide an opening (34) in the concrete.

3. A system according to claim 1 characterized in that the joint formers (42, 43, 44) are made either entirely, or partly of rubber.

4. A system according to claim 1 characterized in that reinforcement members (6c) also extend between said end anchorages (10) at spaced intervals between the pieces of shuttering (2a, 2b) and conventional reinforcement cages 52 are positioned between selected pairs of opposite apertures (4) in said pieces of shuttering (2a, 2*b*) so that the respective core formers (40) can be received within said cages (52).

5. A system according to claim 1, characterized in that said apertures (4) are located at digitally coded positions (18) along the casting bed to enable machinery, which traverses the casting bed along the longitudinal extent of said shuttering, to be automatically controlled to locate the core formers (40) and joint formers (42, 43, 44) at required positions.

6. A system according to claim 1, characterized in that said joint formers each includes a fully resilient joint former (44) having first and second faces (78, 80) which are opposite to one another and which are provided with said grooves (82), a third face (84) which is concave and which is flanked at each side by outwardly extending portions (88), and a fourth face (86) which is opposite the third face (84) and which extends between the first and second faces (78, 80).

7. A system according to claim 1, characterized in that said joint formers each includes a fully resilient joint former (100) having a pair of side flanges (101) each provided with said grooves (82), said joint former (100) having a first plane face (103) which is opposite a second concave face (105) and which is flanked by tapering portions (107) extending between the concavity and the respective side flanges (101).

8. A system according to claim 1, characterized in that said joint formers each includes a partly resilient and a partly rigid joint former (43) wherein the resilient part is in the form of a rib (90) having a series of grooves (91) along its length and the rigid part is in the form of a base (29) attached to the rib (90) and having flange portions (92*a*, 92*b*) extending on each side of the rib (90), said base (92) having a concave face (95).

9. A system according to claim 1, characterized in that said joint formers each includes a fully resilient joint former (42) having a first face (70) in which said grooves (50) are provided, a second face (74) opposite said first face (70), said second face (74) being concave and third and fourth faces (73) opposite to one another and extending between said first and second faces (70, 74).

10. A system according to claim 9 characterized in that said shuttering (2) is used to form a part of a frame within the mould to provide an opening (34) in the concrete.

11. A system according to claim 10, characterized in that a cover (116) is provided for said frame, the cover (116) being positioned by pegs (118) which extend between adjacent core formers (40) received in the respective apertures (4) in said pieces of shuttering (2*a*, 2*b*).

* * * * *